US005801665A

United States Patent [19]

Zhaog et al.

[11] Patent Number: 5,801,665

[45] Date of Patent: Sep. 1, 1998

[54] FORMAT CONVERTER FOR THE CONVERSION OF CONVENTIONAL COLOR DISPLAY FORMAT TO FIELD SEQUENTIAL

[75] Inventors: Yee-Lu Zhaog, Taoyuan; Yen-Chen Chen, Hsinchu, both of Taiwan

[73] Assignee: Industrial Technology Research Institute, Hsin-Chu, Taiwan

[21] Appl. No.: 549,983

[22] Filed: Oct. 30, 1995

[51] Int. Cl.[6] ..... G09G 5/00

[52] U.S. Cl. ..... 345/3; 345/510; 345/199; 345/511

[58] Field of Search ..... 345/150, 154, 345/155, 186, 203, 3, 510, 199, 511

[56] References Cited

U.S. PATENT DOCUMENTS

| | | | |
|---|---|---|---|
| 4,582,396 | 4/1986 | Bos et al. | 350/347 |
| 4,611,889 | 9/1986 | Buzak | 350/337 |
| 4,635,051 | 1/1987 | Bos | 340/757 |
| 4,721,951 | 1/1988 | Holler | 345/154 |
| 4,726,663 | 2/1988 | Buzak | 350/347 |
| 4,758,818 | 7/1988 | Vatne | 340/701 |
| 5,083,257 | 1/1992 | Kennedy | 345/188 |
| 5,221,875 | 6/1993 | Odenthal | 315/14 |
| 5,233,338 | 8/1993 | Surguy | 340/784 |
| 5,337,068 | 8/1994 | Stewart et al. | 345/88 |
| 5,387,920 | 2/1995 | Bos et al. | 345/88 |
| 5,438,373 | 8/1995 | Cummins | 345/155 |

OTHER PUBLICATIONS

"Design Specification—Tektronix Low Speed Scan", Jun. 1994, Omnicomp Graphics Corp. Document No. 8-01000-214-00A01.

"Theory of Operation—Tektronix Low Speed Scan Converter for Tektronix 640×480Nu 700M/Nu 900m" by Mustapha Sharara, Jun. 6, 1994.

"Design Specification—Tektronix High Speed Scan Converter", Jun. 9, 1994, Omnicomp Graphics Corp.

"Theory of Operation—Tektronix High Speed Scan Converter for Tektronix 1280×1024 Nu1900/Cg 191R" by K.G. Hickman, Jun. 9, 1994, Omnicomp Graphics Corp.

*Primary Examiner*—Richard A. Hjerpe
*Assistant Examiner*—Kent Chang
*Attorney, Agent, or Firm*—George O. Saile; Stephen B. Ackerman; Bill Knowles

[57] ABSTRACT

The present invention includes a parallel video format to field sequential video format conversion method wherein multiple analog signals that represent the magnitude of a set of colors that are components of the colors of a video display are converted to a set of digital video codes. This set of video codes buffered and rearranged to align with an input bus. The input bus is operably connected to a bus-exchange means which is operably coupled to a pair of Input/Output busses of two sets of dynamic random access memories. The Digital Video Codes are stored in sequence in the set of dynamic random access memories selected by the bus-exchange circuitry. The bus-exchange circuitry simultaneously selects the other set of the two sets of dynamic random access memories for connection to an Output Bus. The digital video codes are retrieved from the set of dynamic random access memories in a specific order by component color and placed on the output bus. The specifically ordered video codes are multiplexed to form a serial stream of digital video codes. The serial stream is converted in an analog-to-digital converter to an analog signal that is of the format acceptable to field sequential display.

40 Claims, 6 Drawing Sheets

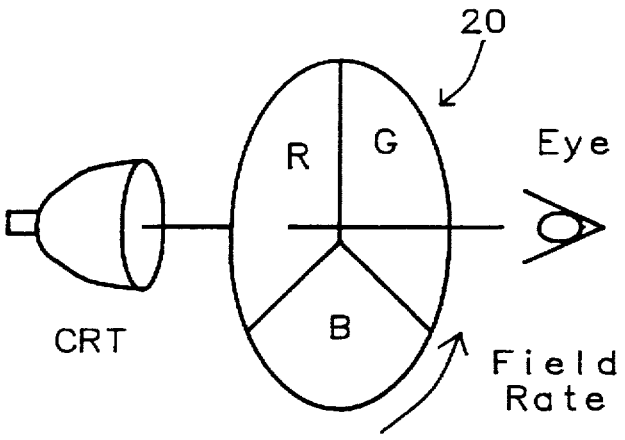
FIG. 1a – Prior Art
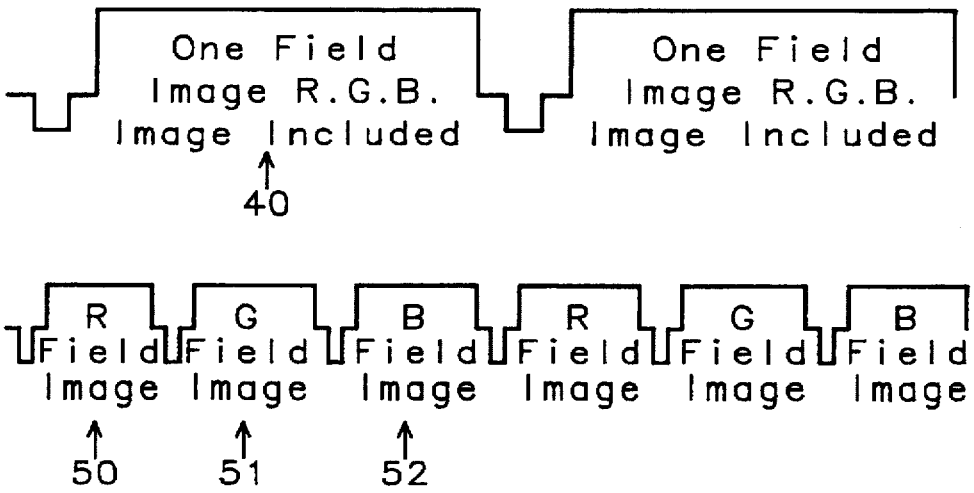
FIG. 1b – Prior Art

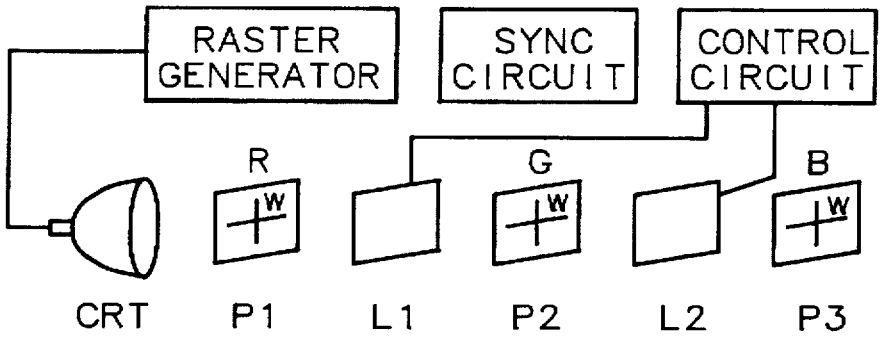
FIG. 2 – Prior Art
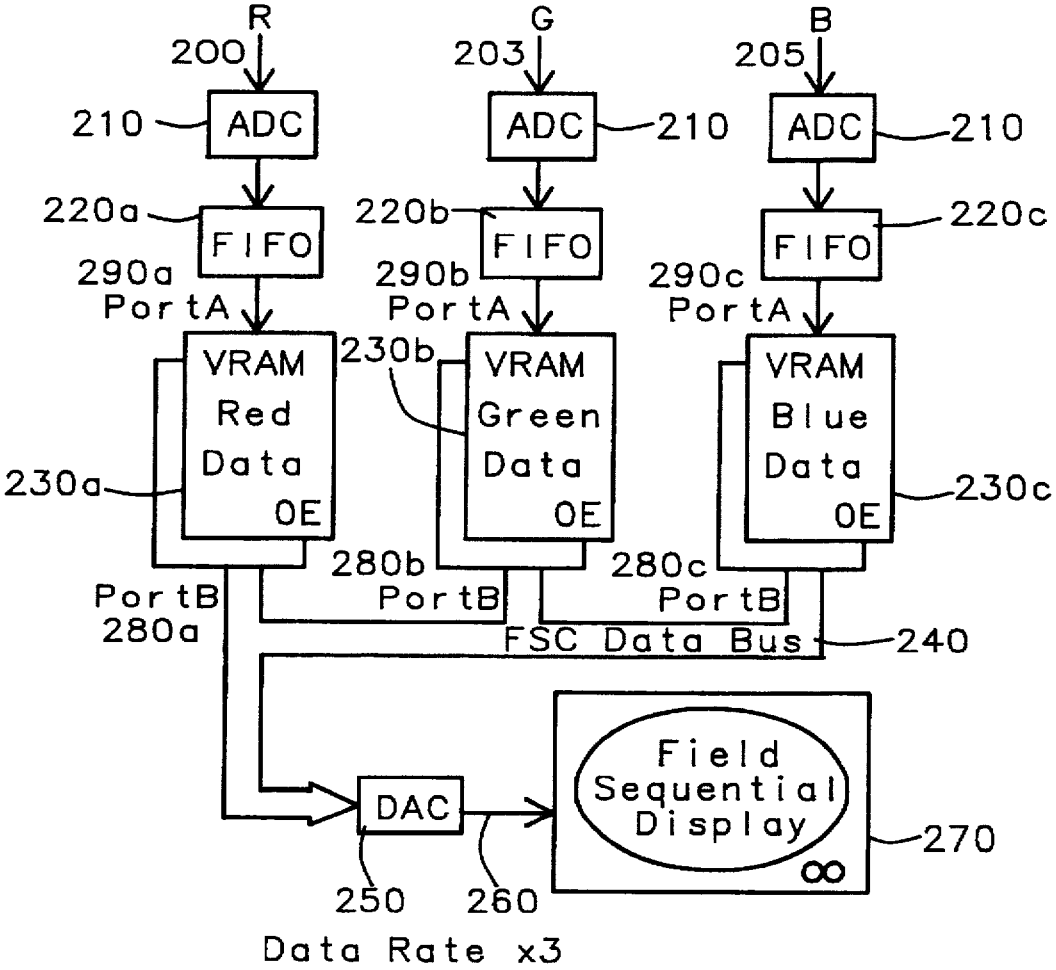
FIG. 3 – Prior Art

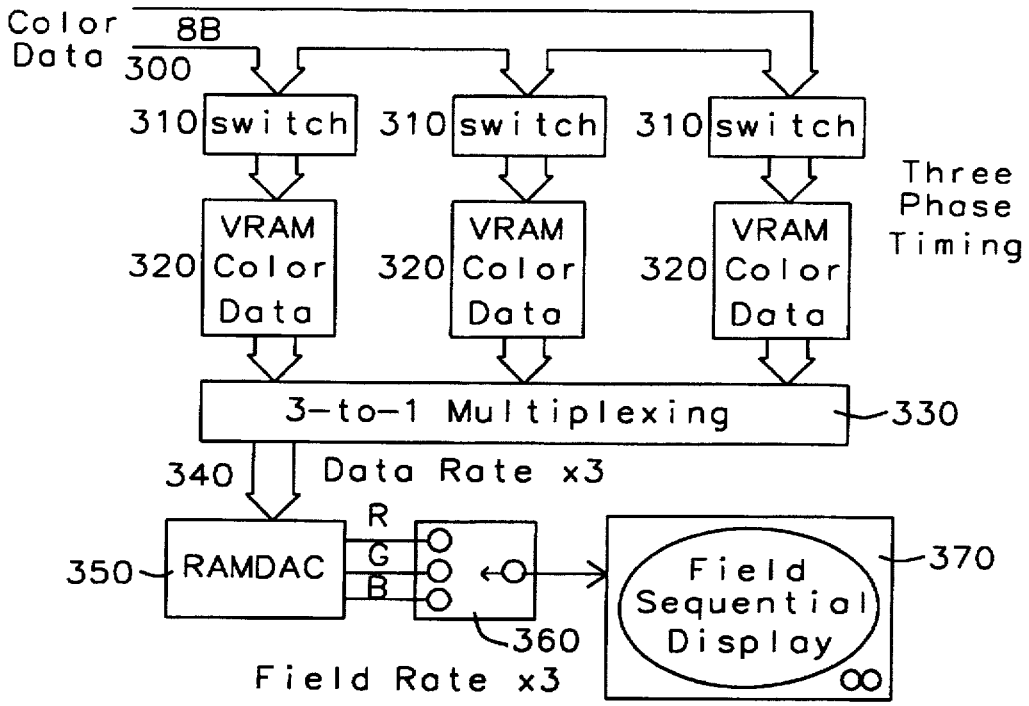
FIG. 4 – Prior Art
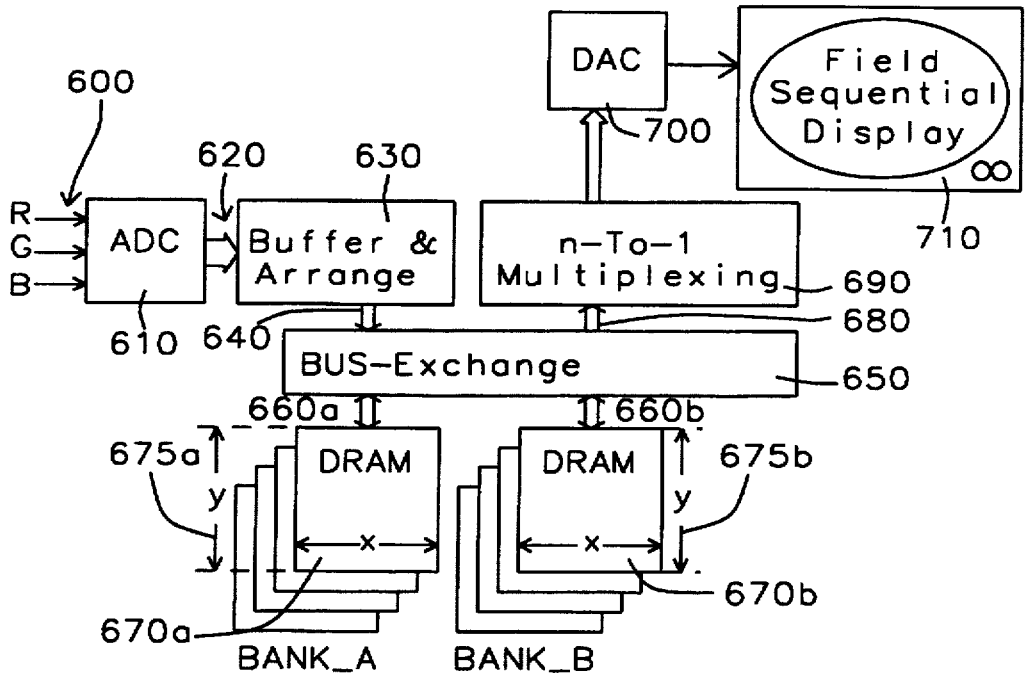
FIG. 5

FORMAT CONVERTER FOR THE CONVERSION OF CONVENTIONAL COLOR DISPLAY FORMAT TO FIELD SEQUENTIAL

BACKGROUND OF THE INVENTION

1. Field of Invention

This invention relates to field sequential color displays that employ liquid crystal optical switches for color selection and in particular to the methods of conversion of universal standard video formats to field sequential format to display video information.

2. Description of Related Art

If red, green, and blue color fields of varying intensity are impinged upon the eye in sequence rapidly enough over time, the human visual system will perform a temporal blending of the image. This phenomena allows the field sequential color displays to sequentially display red, green, and blue monochrome images to create a color display.

A field sequential color display (FSCD) system incorporates a monochrome cathode ray tube (CRT) similar to the type disclosed in U.S. Pat. No. 5,221,875 (issued Jun. 22, 1993 to Odenthal for a "High Resolution Cathode Ray Tube With High Bandwidth Capability"), a color switching device and control circuit as described in U.S. Pat. No. 4,582,396 (issued Apr. 15, 1986 to Bos, et al. for a "Field Sequential Color Display System Using Optical Retardation", U.S. Pat. No. 4,611,889 (issued Sept. 16, 1986 to Buzak for a "Field Sequential Liquid Display with Enhanced Brightness"), U.S. Pat. No. 4,635,051 (issued Jan. 6, 1987 to Bos for High-Speed Color Display System Incorporating Same"), U.S. Pat. No. 4,758,818 (issued Jul. 19, 1988 to Vatne for a "Switchable Color Filter and Field Sequential Full Color Display System Incorporating Same"), U.S. Pat. No. 4,726,663 (issued Feb. 23, 1988 to Buzak for a "Switchable Color Filter with Enhanced Transmissivity"),and U.S. Pat. No. 5,387,920 (issued Feb. 7, 1995 to Bos, et al. for a "Switchable Color Filter and Field Sequential Full Color Display System Incorporating Same"). The color switch device selects the color field to be displayed sequentially and the control circuitry converts the input video data format and provides necessary synchronization of the CRT display and the color switching device.

The original field sequential color display designs as shown in FIG. 1*a* used an electromechanical driven color wheel 20 rotating at the field image rate to sequentially display the red, green and blue colors. Referring to FIG. 1*b*, the video information of one field image 40 is decomposed into three component sub-field images (R Sub-Field Image 50, G Sub-Field Image 51, and B Sub-Field Image 52). These field images were scanned on the CRT at rate three times faster than the normal "One Field Image with R, G, B Image Included" 40. Due to the temporal blending in the human visual system, a color image would be perceived.

A later type of FSCD used a liquid crystal combined with a color polarizer to serve as the color switch. In FIG. 2 the three color selective polarizing filters P1, P2, P3 each let one color pass in the vertical polarizing axis and the white light to pass in the horizontal axis. The liquid crystal devices L1, L2 will, depending on the state of the devices, either allow the polarization rotation of 90 degrees of the light or not. Through the combination of color selective polarizing filters and the liquid crystal devices any of the Red, Green, or Blue colors can be selected.

Nearly all conventional CRTs, create their images spatially. Each picture element is three sub-picture elements spaced too closely for the human eye to differentiate the three elements, but instead sees light from the three colors as a single color. This has allowed multiple sets of standards for the electronic transmission of video images with color data contained in multiple signals. Most standards use three color signals, red, green, and blue, that will be transmitted simultaneously. For these images to be displayed on the FSCD's, the multiple signals must be transformed to a format that is acceptable for FSCD's and the field rate of each frame of the video to be displayed must be increased by a factor of that is a multiple of the number of the component colors. For the example of three component colors, the field rate is increase by a factor of three.

An example of the format conversion as described in "Design Specification—Tektronix Low Speed Scan", Jun. 6, 1994, Omnicomp Graphics Corp., Document No. 8-01000-214-00A01; "Theory of Operation—Tektronix Low Speed Scan Converter for Tektronix 640X480 Nu 700M/Nu 900M"by Mustapha Sharara, Jun. 6, 1994, Omnicomp Graphics Corp.; "Design Specification—Tektronix High Speed Scan Converter" Jun. 9, 1994, Omnicomp Graphics Corp.; and "Theory of Operation—Tektronix High Speed Scan Converter for Tektronix 1280 X1024 Nu1900/Cg 191R" by K. G. Hickman, Jun. 9, 1994, Omnicomp Graphics Corp. is shown in FIG. 3. The Red 200, Green 203, and Blue 205 Parallel Video Signals are input to three 8 bit analog-to-digital converters (ADC) 210*a*, 210*b*, 210*c*. The outputs of the ADC's 210*a*, 210*b*, 210*c* are the inputs to the First In First Out Data Registers (FIFO's) 220*a*, 220*b*, 220*c* which are used to synchronize the data with the rest of the display system. At the appropriate time each of the three sets of the Video Random Access Memory (VRAM's) 230*a*, 230*b*, 230*c* access the FIFO's 220*a*, 220*b*, 220*c* and the Video Data is stored in each VRAM 230*a*, 230*b*, 230*c* set where the transformation to the FSCD format takes place. Each VRAM 230*a*, 230*b*, 230*c* has two ports which can access the memory array. The digitized video data is placed in the memory arrays on Port A 290*a*, 290*b*, 290*c* at a rate that represents the frame rate of the conventional display. The data will then be read out to the FSC Data Bus 240 at a rate three times that of the incoming video frame rate with the Red Data 280*a* being accessed followed by the frame information in the Green Data 280*b*, and that followed by the frame information in the Blue Data 280*c*. The FSC Data Bus 240 is the input of a digital-to-analog converter (DAC) 250 that forms the analog video signal 260 to modulate the intensity of the light emitted from the CRT of the FSCD 270.

Another form of transformation from conventional video to FSCD format is described in the Preliminary Specification for "RGB Liquid Crystal Shutter Display" published May 9, 1990 by Tektronix, Inc. Display Products, and shown in FIG. 4. The Color Data 300 is placed on an 8 bit input bus. The Color Data represents 256 individual colors Each of the 256 colors is defined as a subset of the potential 256×24 colors that could be available. The magnitude of each of the component colors that compose the color pallet are stored in the random access memory section of the RAMDAC 350. The Color Data 300 acts as an address for the RAMDAC 350. In order to match the operating speed of the VRAM's 320, every third segment of the Color Data 300 is placed in each of the VRAM's 320. As one of the VRAM's has Color Data 300 stored to it another of the VRAM's is placing the stored Color Data on its output bus. The outputs of the VRAM's 320 are operably connected to the inputs of the 3-to-1 multiplexor 330. Each of the inputs of the 3-to-1 multiplexor 330 is selected serially to be operably coupled to the output 340 of the 3-to-1 multiplexor 330 thus increasing the data rate by a factor of three or back to the original data rate of the Color Data 300. The output 340 of the 3-to-1 multiplexor 330 is operably connected to the input of the RAMDAC 350. The RAMDAC 350 consists of a color palette RAM capable of holding codes describing the magnitudes of the three color components for 256 colors and a digital-to-analog converters which can convert the data from color the palette RAM to three analog signals representing the three color components (red R, green G, and blue B) of the Color Data 300. The output of the RAMDAC 350 is operably connected to a Field Rate Switch 360 which will serially select the analog color signals from the RAMDAC 350 and place them at a signal rate three time the Field Rate of the Color Data 300 as the input to modulate the intensity of the electron beam of the Field sequential color display 370.

The aforementioned transformation systems require a plurality of costly VRAM's with a complex addressing scheme, and requiring multiple banks of VRAM's for high resolution video displays.

Other field sequential color display devices as described in U.S.

Pat. No. 5,233,338 (issued Aug. 3, 1993 to Surguy for Display Devices Having Color Sequential Illumination") and U.S. Pat. No. 5,337,068 (issued Aug. 9, 1994 to Stewart, et al. for a "Field sequential color display System Utilizing a Backlit LCD Pixel Array and Method for Forming an Image") use liquid crystal displays that are back lit by red, green, and blue lights that are activated in a time serialized fashion to form color display.

SUMMARY OF THE INVENTION

An object of the invention is the creation of a converter for the transformation of parallel analog or digital color video signals to a format suitable for a field sequential display. Furthermore, another object is the simplification of the complex addressing scheme that is used with VRAM transformation systems.

The display format converter will receive video signals representing a plurality of component colors. These video signals are passed into an input circuit which, if the video signals are parallel analog video signals, will convert them into digital video codes that are representations of the amplitude of the analog video signals. If the video signals are digital video codes, the input circuitry acts as an amplifier and buffer to insure that the input digital video signals are of correct amplitude to match the following circuitry.

The digital video codes are placed on the digital video bus which is operably connected to the buffer and arrange means, wherein the set of digital video codes are retained during their rearrangement so as to align with the input bus. The input bus is operably connected to a bus exchange means that will selectively pass the set of digital video codes to one of a plurality of Input/Output busses, Each Input/Output Bus is operably connected to a plurality of dynamic random access memories. The dynamic random access memories store a set of the multiple sets of digital video codes and retrieve the set of the multiple sets of digital video codes in a specific order that is the serialization of the digital video codes by color component. The retrieved set of specifically ordered digital codes are placed on the Input/Output bus and passed to the bus exchange means. The bus exchange means will operably couple the Input/Output bus to the Output bus. The Output bus is operably connected to an "n"-to-1 multiplexing means, which converts the specifically ordered digital video codes into a serial stream of digital video codes that are organized by component color order. The serial stream of digital video codes are passed to a digital-to-analog converter. The digital-to-analog converter converts the digital video codes to analog signals of format acceptable as the input a field sequential color display.

BRIEF DESCRIPTION OF FIGURES

FIG. 1*a* and 1*b* are illustrations of prior art using an electromechanical color wheel to generate the component colors of the field sequential color display.

FIG. 2 is an illustration of prior art using Color Selective Polarizers and LCDs to form an electronic shutter for a field sequential color display.

FIG. 3 is a schematic diagram of prior art for the conversion of standard parallel analog video format to a format required for a field sequential color display.

FIG. 4 is a schematic diagram of prior art for the conversion of standard color video data to a format required by a field sequential color display.

FIG. 5 is a schematic diagram of an implementation of this invention.

DETAIL DESCRIPTION OF INVENTION

In order to reduce the complexity and cost of the transformation conventional video formats to field sequential format in a continuous real time manner, this invention, as illustrated in FIG. 5 uses two banks of Dynamic Random Access Memories (DRAM's) 670*a*, 670*b* and the Bus-Exchange circuitry 650 to replace the two port VRAM's of the prior art. Each DRAM Bank 670*a*, 670*b* can contain the video information for one frame of the conventional Parallel Analog Video Data 600. The Conventional Parallel Analog Video Data 600 is converted in a plurality of ADC's 610 to a set of Digital Video Codes that are placed on the Digital Video Bus 620. The Digital Video Bus 620 is input to the Buffer and Arrange Circuitry 630 which rearranges the order of the Digital Video Codes to align with the Input Bus 640. The Bus-Exchange Circuitry 650 operably exchanges the coupling of the Input/Output (I/O) busses 660*a*, 660*b* of the two banks of the DRAM's 670*a*, 670*b*, between the Input Bus 640 and the Output Bus 680. In one video display frame the I/O bus 660*a* of Bank_A 670*a* is operably coupled to the Input Bus 640 and the I/O bus 660*b* of Bank_B 670*b* is connected to the Output Bus 680. In the next succeeding video frame the Bus Exchange Circuitry 650 changes state and the I/O bus of Bank_A 670*a* is operably connected to the Output Bus 680 and the I/O Bus of Bank_B 670*b* is operably connected to the Input Bus 660. In this time period the DRAM's of Bank_A have video data being retrieved in an order such that all the Digital Video Codes for the first component color are all retrieved, the Digital Video Codes for the second component color are retrieved and this process being repeated until all the Digital Video Codes have been retrieved and sent to the m-to-1 Multiplexor 690 where the Digital Video Codes are now converted to a stream of individual codes that are then passed on to the DAC 500. In the DAC 500, the series of Digital Video Codes are now converted to an Analog Signal that is of the format required for the FSCD 510. The field sequential analog signal is then passed on to the FSCD to modulate the intensity of the light from the display. In this same time period the DRAM's of Bank_B 670*b* is having the next frame of video data being stored to it from the Buffer and Arrange Circuitry 630.

Figure 6:
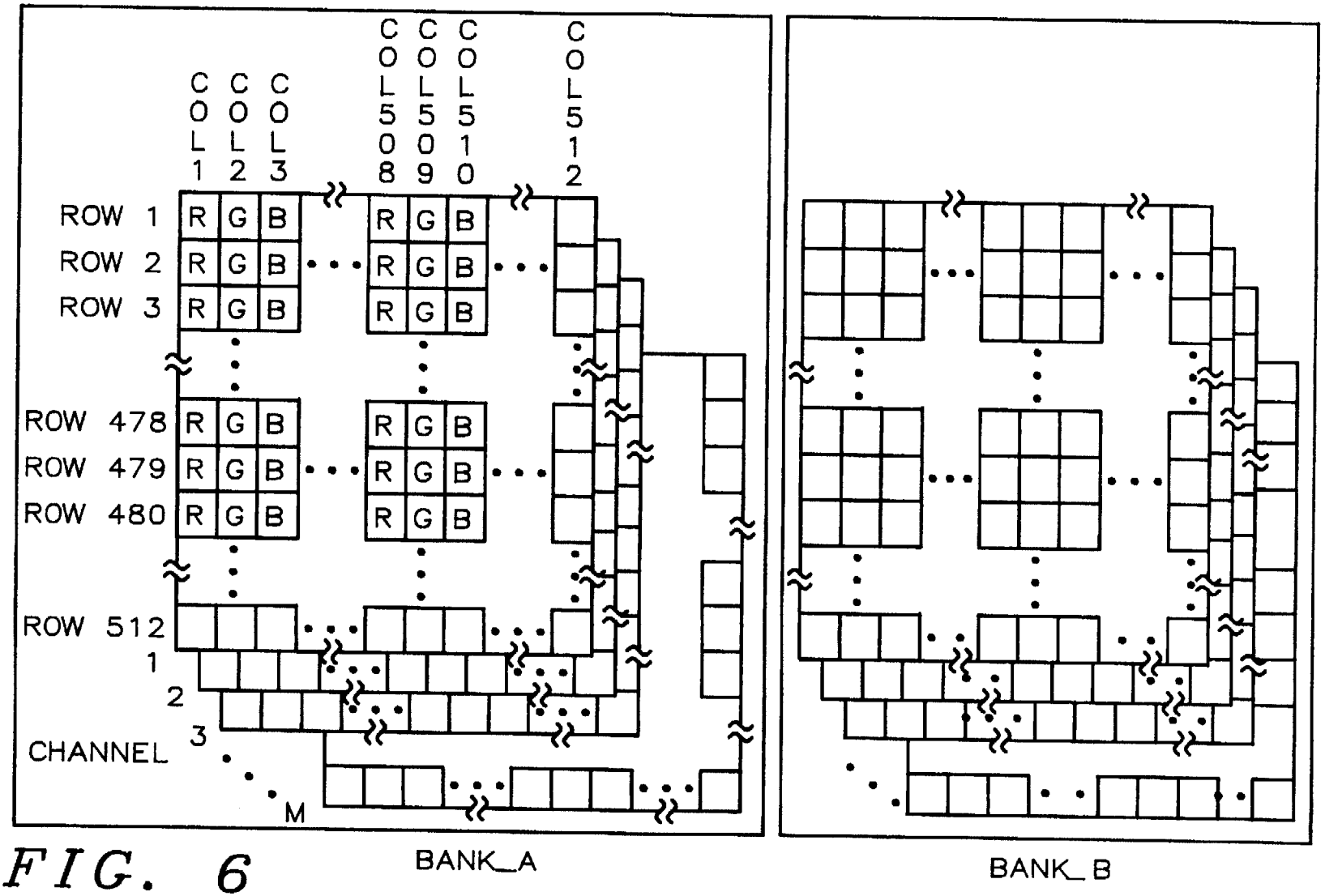
FIG. 6 is a schematic diagram of the organization of the DRAM's of this invention.

Referring to FIG. 6, each of the two banks of DRAM's (FIG. 5 670*a* 670*b*) is organized is a three dimensional array of cells having M channels of cells on the first dimension, X cell in the second dimension, and Y cell in the third dimension. Each cell of the array contains one code of data representing the video information of one of the three colors (R,G,B) of the incoming video signals.

An example would be a Video Graphics Adapter Standard wherein each display video frame will have 640 picture elements per scanned display line with 480 lines of video information per frame with three bytes of color information per picture element and each picture element consists of three colors (Red, Green, and Blue). In FIG. 5 the Analog Video Signal 600 will consist of three separate signals of the component colors (R,G, B). The Analog Video Signal 600 is converted in three ADC's 610 to form the RGB Data Word 620. The RGB Data Word 620 is rearranged in the Buffer and Arrange Circuit 630 to align with the Input Bus 640.

Referring to FIG. 5 the width of the Input Bus 640, Output Bus 680, and the I/0 Busses 660*a*, 660*b* is the same width as the "m" dimension of the banks of DRAM's 670*a*, 670*b*. The number of number of channels of cells in the M dimension is determined by the ratio:

$$RS/AADR$$

Where

RS=Required Speed of the FSCD

AADR=Actual Access Data Rate of the DRAM Technology rounded to the next highest integer.

In the example of the VGA Standard as shown in FIG. 5, with the three color components that describe the colors the standard will scan at 25 Mhz for a conventional display. The FSCD will require a scan rate of 75 Mhz. Present day DRAM Technology has a data rate of approximately 20 Mhz. Therefore the number of channels of cells in the M dimension will be:

$$75\ \text{Mhz}/20\ \text{Mhz} = 4\ \text{Channels of Cells}$$

Referring to FIG. 5 the total number of cells in the X will be determined by the ratio:

$$TPE*NC/M$$

Where

TPE=Total Picture Elements in the X dimension of a Display Frame

NC=the number of Component Colors

M=the first dimension of DRAM array rounded to the next highest integer.

In the example of the VGA standard having 640 picture elements per scanned line, the total data stored per scanned line must be $$640\times3=1920\text{digital codes.}$$

I there are 4 channels in the M dimension, then each channel of cells must contain at least 480 cells or 160 sets of digital video codes on each row. In order for each bank (Bank_A or Bank_B) to contain a full video frame then each channel must contain at least 480 rows.

In present day DRAM chip technology that is organized in a 512×512×4 bit organization, two DRAM chips are connected in parallel to form a single channel. And with 4 channels per bank, each bank (Bank_A or Bank_B) will contain 2M bytes of data.

Referring to FIG. 6, the video digital codes for the first component color, red R, of the first "M" picture elements (in the VGA example M=4) are placed in the first column and the first row of each of the channels of the DRAM's. The second component color, green G, for the first 4 picture elements are placed in the second column of the first row and the third component color, blue B, are placed in the third column of the first row. The set of component colors for the second set of 4 picture elements are placed in the columns adjacent to those occupied by the set of component colors for the first 4 picture elements in each of the channels of the DRAM's. This sequence of the placement of the set of component colors for each set of the 4 picture elements is placed adjacent to the previous block of the 4 picture elements in the first row of the DRAM's until all the digital video codes for the first horizontal scan line of the frame of the video display has been stored. In the VGA example, 510 columns can be occupied to give 170 sets of the digital video codes and with four channels there is a possibility of 680 cells which is more than the 640 needed to contain a full horizontal scan line. Each subsequent line is now stored in each corresponding row until all the digital video codes that describe the frame of the video display are placed in the bank of the DRAM's. In the example of the VGA standard, there will be 480 rows occupied to contain the digital data of a single frame of the video display.

The DRAM's have an operational mode referred to as "Fast Page Mode". This allows each DRAM chip to be presented a row address and a series of column addresses which will allow the digital data to be stored to or retrieved from the DRAM's at a much faster rate.

The digital video codes can now be retrieved from the DRAM's in the order necessary to match the requirements necessary to match the FSCD. The first row of the DRAM and each column containing the digital video codes for a single color are accessed sequentially until a full row has been retrieved. Each row is accessed sequentially, accessing each column containing the digital video codes for the single color until all the rows have been retrieved. Then the next component color is access and retrieved followed by the next until all the component colors have been retrieved.

In the VGA example, the first column of the first row containing the digital code for the red R component color of the first picture element is retrieved followed by the next column containing the digital code for the Red R component color of the next picture element in that channel. This process continues until a full row has been retrieved. The row address is incremented and the next row is retrieved by incrementing the column address by the increment of the number of colors in this case three. Each row is retrieved until all the digital video codes that describe the red R component color has been retrieved. Then the digital video codes that describe the green G component color are retrieved, followed by the retrieval of the digital video codes that describe the blue B component color of the frame of the video display.

In FIG. 5, since the FSCD 610 scans the full frame of each color individually and sequentially, the video data must be transferred to the DAC 600 at a rate that is "y" (where"y" is the number of component colors of the Conventional Parallel Analog Video 600) times faster than the conventional parallel video. Since the data is being retrieved from the banks of DRAM's (Bank_A 670*a*, Bank_B 670*b*) at a rate determined by the technology of the DRAM component, the Output Bus 680 must be serialized in the M-TO-1 Multiplexor 690 to form a serial train of color information that is the input to DAC 600 (M is the number of bytes of video data present on each of the I/0 Busses 660*a*, 660*b* of each of the DRAM Banks 670*a*, 670*b*).

In the example of the VGA, The 110 Bus is 4 bytes wide being read in at a rate of ¾ the conventional RGB video data rate or 18.75 Mhz. The M-to-1 Multiplexor (where M=4) multiplies the transfer rate by a factor of 4 or to three times the conventional data rate or the rate required by the FSCD (75 Mhz).

Figure 7:
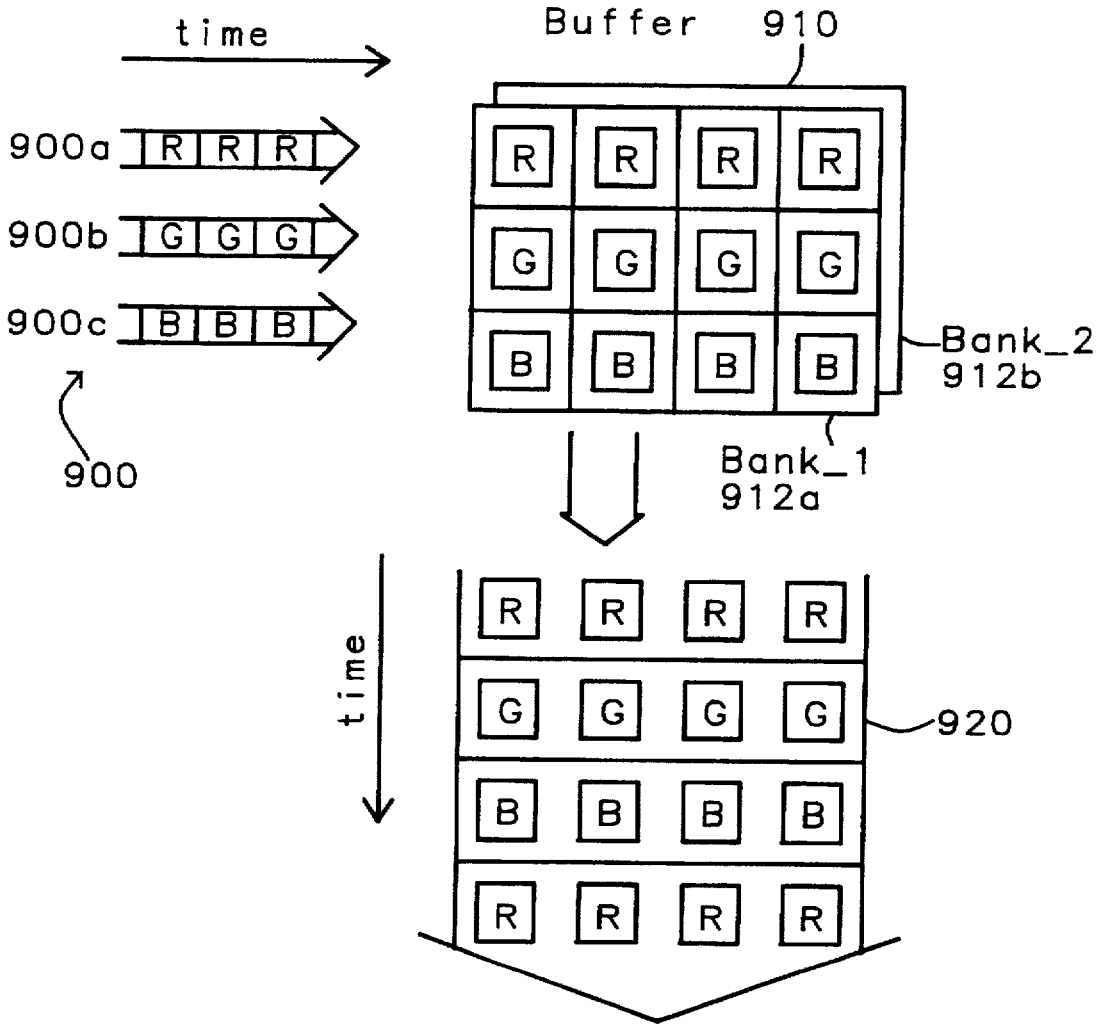
FIG. 7 is a diagram of the organization of the Buffer and Arrange Circuitry of this invention.

FIG. 7 illustrates the an implementation of the preferred embodiment of the Buffer and Arrange Circuit. The Digital Video Codes 900 is placed in the Buffer with the Red (R) Digital Video Codes 900*a* being placed in Row A, the Green (G) Digital Video Codes 900*b* being placed in Row B, and the Blue (B) Digital Video Codes 900*c* being placed in Row C. The data is transferred from the buffer to the Input Bus with Row A being read first followed by Row B followed by Row C. The Buffer contains two sections Bank1 912*a* and Bank2 912*b*. Bank1 912*a* will have the video data being placed in it while the Bank2 912*b* will have data being retrieved from it and placed on the Input Bus 660 of FIG. 6. The data rate at which the conventional RGB video is being read in is at the display frame rate; whereas the input bus will be transferring the data at a rate that is equal to:

*NCC/WIB* where

NCC=The Number of Color Components

WIB=The Width of the Input Bus

In the example of the VGA standard the data will be placed in the Buffer and Arrange Circuit 630 of FIG. 6 is at a rate of 25 Mhz and placed on the Input Bus at a rate of 18.75 Mhz or ¾ the data rate.

Figure 8:
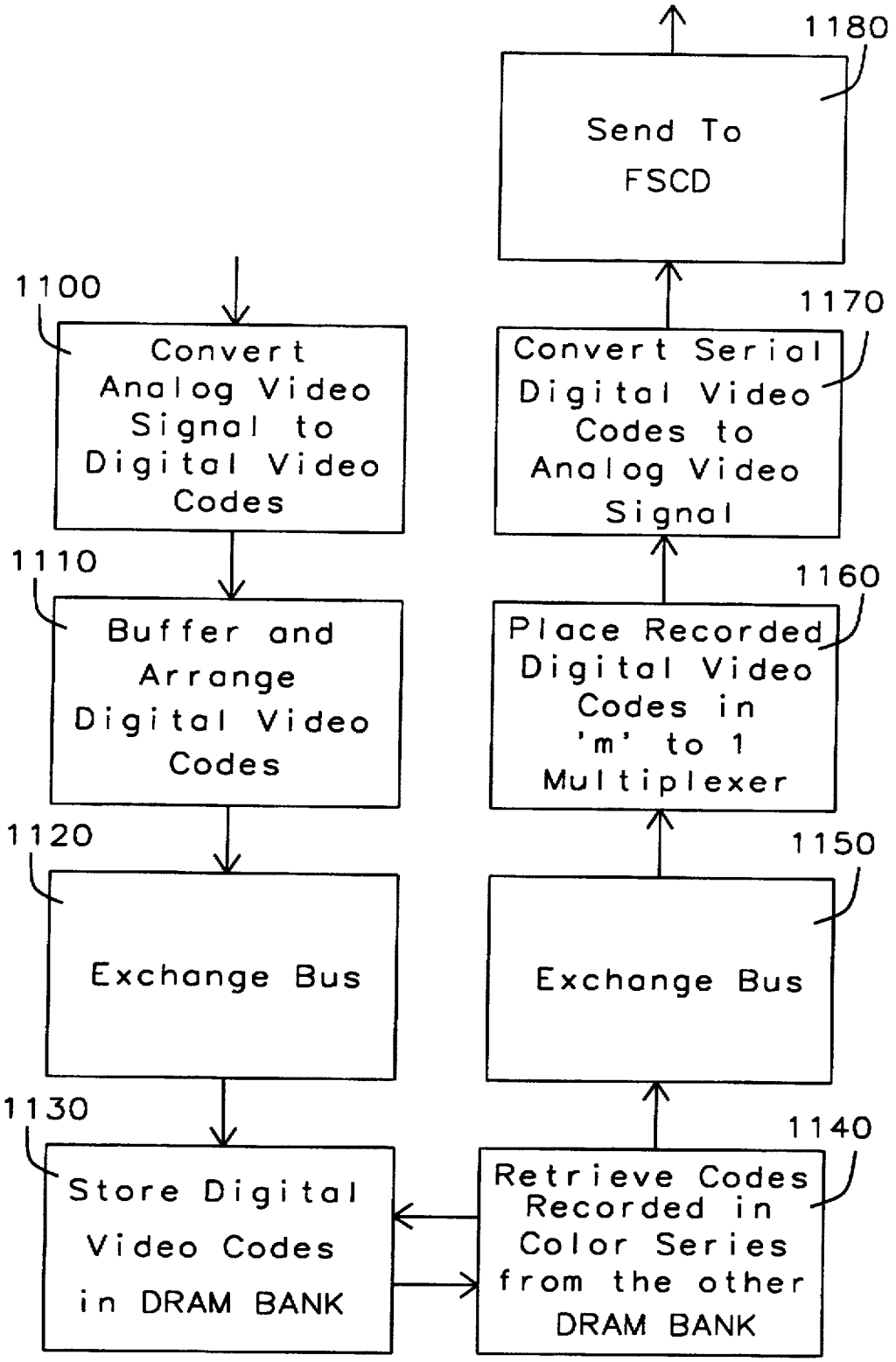
FIG. 8 is a diagram of the process for the method of format conversion of this invention.

Referring to FIG. 8, the of the method for the conversion from a conventional parallel video signal to one that is acceptable for an FSCD is the inputting of the video signal representing the amplitudes of the color components of the video display 1100. If the input video signals are parallel analog video signals, they are converted in an analog-to-digital converter to a set of digital video codes representing the magnitudes of the parallel analog video signals. However, if the input video signals are a set of digital video codes representing the magnitude of the color components of the video signal, the video signals are amplified to level acceptable by subsequent circuitry. The digital video codes are then buffered and rearranged to align to the input bus 1110. The input bus connections are then exchanged 1120. If the previous connection to the input bus has been the I/0 bus of Bank_B, the I/O bus of Bank_A would be connected to the input bus. If, however the I/0 bus of Bank_A had been connected on the previous iteration to the input bus, the Bank_B would be connected to the input bus. The next step is the storing of the rearranged digital video codes in the bank of the DRAM that is connected to the input bus 1130. At the same time another of the set of digital video codes is being retrieved in color series order from the opposite bank of the DRAM's 1140. The I/0 bus for the DRAM's from which the digital video codes are being retrieved is exchanged to connect to the output bus 1150. The color serialized digital video codes are placed in an m-to-one multiplexor to further serialize the digital video codes 1160. The serialized digital video codes are converted into an analog video signal acceptable by the FSCD 1170 and sent to the FSCD to modulate the intensity of the light emitted from the FSCD 1180. The aforementioned method is repeated to create a series of video frames that compose the information to be displayed on the FSCD.

What is claimed:

1. A display format converter for the transformation of color video signals to a format for a field sequential color display comprising:

a) a video input means for the receiving of video signals representing a plurality of component colors;

b) a digital video bus means operably connected to the video input means;

c) a buffer and arrange means connected to the video input bus means for buffering of a set of digital video codes to retain the set of digital video codes during the arranging of the set of digital video codes;

d) an input bus connected to the output of the buffer and arrange means;

e) a bus exchange means connected to the input bus, wherein the input bus operably couples the buffer and arrange means to the bus exchange means;

f) a plurality of Input/Output busses connected the bus exchange means;

g) a plurality of dynamic random access memories connected to the plurality of Input/Output busses, to store a set of the multiple sets of digital video codes and to retrieve and reorder said set of the multiple sets of digital video codes in a specific component color order to form specifically ordered digital video codes;

h) an output bus connected to the bus exchange means;

i) an n-to-one multiplexing means to convert the specifically ordered digital video codes to a serial stream of said specifically ordered digital video codes;

j) a digital-to-analog converter connected to the output of the n-to one multiplexor for the conversion of the serial stream of the specifically ordered digital video codes to an analog signal of the format acceptable as the input for a field sequential display; and k) a field sequential color display analog input means to operably couple the digital-to-analog converter to the field sequential display.

2. The display format converter of claim 1 wherein the video input means may comprise an analog-to-digital conversion means if the video input signal is an analog video signal representing the magnitude of the plurality of component colors.

3. The display format converter of claim 1 wherein the video input means may comprise a digital receiver means if the video input signal is a set of digital video codes representing the magnitude of component colors.

4. The display format converter of claim 2 wherein the video analog-to-digital conversion means is further comprising:

a) an analog video input port operably coupled to the analog input means;

b) a plurality of analog-to-digital converters operably coupled to the analog video input port and a digital video output port for the conversion of the analog video signals, comprising a plurality of analog signals representing the magnitude of a set of component colors describing a video display frame, to a set of digital video codes representing the magnitude of the analog video signal; and c) the digital video output port operably coupled to the digital video bus.

5. The display format converter of claim 3 wherein the digital receiver places the digital video codes on the digital video bus.

6. The display format converter of claim 2 wherein the analog video signal is comprising a set of codes representing each of a plurality of component color magnitudes describing a first full color video display frame of a plurality of full color video display frames.

7. The display format converter of claim 1 wherein the buffer and arrange means is further comprising:

a) an in-port operably coupling the digital video bus to a plurality of banks of storage cells;

b) the plurality of banks of storage cells wherein each bank is organized in an array of rows and columns, with the in-port operably connected to the rows of the plurality of banks and an out-port operably coupled to the columns of the plurality of banks;

c) the out-port that is operably coupling the plurality of banks of storage cells to the input bus; and d) a buffer control logic means that selects a single bank from the plurality of banks of storage cells to activate to receive the digital video codes from the in-port, while simultaneously selecting another single bank of the plurality of banks of storage cells to activate to transmit the digital video codes in a rearranged order to the out-port.

8. The display format converter of claim 1 wherein the bus exchange means is comprising:

a) a first exchange port operably coupled to the input bus;

b) a second exchange port operably coupled to the output bus;

c) a plurality of exchange ports operably coupled to the plurality of Input/Output busses, d) a switching means operably coupled to each of the exchange ports and to a coupling selection port; and e) an exchange selection means operably coupled to the coupling selection port to select the operable coupling of the first exchange port to one of the exchange ports operably coupled to the plurality of Input/Output busses, and to select the operable coupling of the second exchange port to one of another of the plurality of exchange ports operably coupled to the plurality of Input/Output busses, and to exchange the first and second exchange ports to other of the exchange ports operably coupled to the plurality of Input/Output busses.

9. The display format converter of claim 1 wherein each set of dynamic random access memories is comprising:

a) an Input/Output port operably coupled to the Input/Output bus;

b) a plurality of storage cells organized in a two dimensional array, comprising a first dimension and second dimension, wherein each cell can contain one digital video code;

c) an address selection means for selection of the set of storage cells wherein the digital video codes will be placed and retrieved; and d) a data steering logic means that operably couples the Input/Output port to the selected set of storage cells for the placement or removal of the digital video codes.

10. The display format converter of claim 1 wherein the number of storage cells of the first dimension of the array of the dynamic random access memory is equal to or greater than the number of digital video codes that is the fractional values of the total number of digital video codes required to describe a single horizontal scan line of the full color video display divided by the number of digital codes present on the Input/Output bus.

11. The display format converter of claim 1 wherein the number of cells in the second dimension is equal to or greater than the number of horizontal scan lines of the full color video display frame.

12. The display format converter of claim 1 wherein the storing of the digital video codes is comprising the steps of:

a) initializing the address selection means to select a first address location in the dynamic random access memory;

b) placing the first set of digital video codes in the first address location;

c) incrementing the address selection means to select to a second address location that is adjacent to the first address location on the first dimension of the array of the dynamic random access memory;

d) placing the second set of video codes in the second location;

e) repeatedly and sequentially incrementing the address selection means to select a next adjacent address in the dynamic random access memory until all the digital codes for the single horizontal scan line has been stored;

f) incrementing the address selection means to select a second address on the second dimension;

g) placing a second set of digital codes representing a second horizontal scan line of the full color video frame in the cells of the first dimension of the second address of the second dimension; and h) repeatedly and sequentially incrementing the address selection means and placing each of the horizontal scan lines of the full color video display at each address location on the second dimension until all scan lines are place in cells.

13. The display format converter of claim 1 wherein the retrieving of the digital video codes is further comprising the steps of:

a) initializing the address selection means to select a first address location of the first component color for the first picture element of the first horizontal scan line in the dynamic random access memory;

b) retrieving the first set of first digital video codes for the first component color;

c) placing the first set of digital video codes for the first component color on the Input/Output port;

d) repeatedly and sequentially incrementing the address selection means by a number of address locations equal to the number of component colors until all the locations containing the digital video codes that describe the first component color of the first horizontal scan line have been addressed;

e) repeatedly retrieving the next set of digital video codes for the first component color;

f) repeatedly placing the next set of digital video codes for the first component color at the Input/Output port; and g) incrementing the address selection means to select the second address location on the second dimension;

h) retrieving the second set of digital video codes representing the first component color of the horizontal scan line of the full color video display frame from all the cells on the first dimension of the second address on the second dimension;

i) repeatedly and sequentially incrementing the address selection means and retrieving all of the cells containing the first component color from each address on the second dimension until all of the horizontal scan lines for the first component color of the full color video display frame are retrieved; and j) repeating sequentially the aforementioned steps for each of the component colors until all the digital video codes for the full color video display frame have been serially placed on the Input/Output bus.

14. A display format converter of claim 1 wherein the n-to-one Multiplexor means is comprising:

a) a multiplexor input port operably connecting the output bus to a multiplexor means;

b) the multiplexor means that receives and retains the specifically ordered digital video codes from the multiplexor input port and places each individual code on an multiplexor output port in a serial and sequential pattern to create the serial stream of digital video codes; and c) the multiplexor output port operably connecting the multiplexor means to the digital-to-analog converter.

15. A method for the conversion of conventional color display format to field sequential color format comprising the steps of:

a) inputting of video signals representing each of a plurality of component color magnitudes describing a first full color video display frame of a plurality of full color video display frames;

b) buffering of a set of digital video codes to retain the set of digital video codes during the arranging of said set of digital video codes to align with an input bus;

c) operably connecting the input bus to a first Input/Output bus of a plurality of Input/Output busses;

d) storing of a first portion of the set of digital video codes representing a first display frame of the plurality of full color video display frames in a first Dynamic Random Access Memory operably connected to the first Input/Output bus;

e) operably connecting the first Input/Output bus of a plurality of Input/Output busses to an output bus and simultaneously connecting a second Input/Output of the plurality of Input/Output busses to the input bus;

f) retrieving from the first dynamic random access memory the set of digital video codes representing the first full color video display frame in a specific order with the set of digital video codes for the first component color being first, the set of digital video codes for the second component color being second and sequentially retrieving each set of digital video codes for each component color until all the sets of digital video codes for the set of component colors have been retrieved;

g) while simultaneously storing to a second dynamic random access memory the set of digital video codes representing a second full color video display frame sequentially in the order determined during the arranging step;

h) placing the specifically ordered set of digital video codes from the first dynamic random access memory on the first Input/Output bus which is operably connected to the output bus, which is the input to an n to one multiplexing means, wherein n is the width in number of digital video codes of the output bus i) multiplexing the specifically ordered set of digital video codes in the n to one multiplexing means to form a serial stream of the specifically ordered set of digital video codes;

j) converting the serial stream of the specifically ordered set of digital video codes in a digital-to-analog converting means to an analog video signal of a proper format that is an input to a field sequential color display to modulate the intensity of the light emitted; and k) repeating each of the aforementioned steps for each of a succession of analog video signals that describe a plurality of full color video display frames.

16. The method of claim 15 wherein the inputting of the video signals may comprise the converting of a set of analog video signals representing the magnitudes of a plurality of component colors to multiple sets of digital video codes representing magnitudes of the analog video signals.

17. The method of claim 15 wherein the inputting of the video signals may comprise the receiving of a set of digital video codes that represent the magnitudes of the component colors of the video signal.

18. The method of claim 15 wherein the sets of digital video codes representing the plurality of component colors where each set of digital video codes comprising a plurality of digital video codes representing an amplitude of a component color for each of the picture elements of a video display frame.

19. The method of claim 15 wherein the steps of buffering and arranging are accomplished in a buffering and arranging means comprising:

a) multiple sets of latching means wherein each set of latching means is comprising:

a first input connection operably coupled to a digital video bus, a plurality of data storage means, and a second connection operably coupled to the input bus; and b) a logic selecting means wherein the set of digital video codes are selected to be captured by one of the latching means and simultaneously selecting another set of latching means to place the digital video codes on the input bus in alignment with the input bus.

20. The method of claim 15 wherein the coupling of the input bus and the output bus to an appropriate Input/Output bus of the plurality of Input/Output busses is accomplished by a bus exchanging means comprising:

a) a first exchange port operably coupled to the input bus;

b) a second exchange port operably coupled to the output bus;

c) a plurality of exchange ports operably coupled to the plurality of Input/Output busses;

d) a switching means operably coupled to each of the exchange ports and to a coupling selection port; and e) an exchange selection means operably coupled to the coupling selection port to select the operable coupling of the first exchange port to one of the exchange port operably coupled to the plurality of Input/Output busses, the second exchange port to one of another of the plurality of exchange ports operably coupled to the plurality of Input/Output busses and to exchange the first and second exchange ports to other of the exchange ports operably coupled to the plurality of Input/Output busses.

21. The method of claim 15 wherein the storing and retrieving of the digital video codes is accomplished in multiple sets of dynamic random access memories wherein each set of dynamic random access memory is comprising:

a) an Input/Output port operably coupled to the Input/Output bus;

b) a plurality of storage cells organized in a plurality of channels of two dimensional arrays, wherein each two dimensional array is comprising a first dimension and second dimension, wherein each cell can contain one digital video code;

c) an address selection means for selection of the set of storage cells, wherein the digital video codes will be placed and retrieved; and d) a data steering logic means that operably couples the Input/Output port to the selected set of storage cells for the placement or retrieval of the digital video codes.

22. A method for the conversion of conventional color display format to field sequential color format of claim 21 wherein the number of storage cells of the first dimension of the array of the dynamic random access memory is equal to or greater than the number digital video codes that is the fractional value of the total number of digital video codes required to describe a single horizontal scan line of the full color video display divided by the number of digital codes present on the Input/Output bus.

23. A method for the conversion of conventional color display format to field sequential color format of claim 21 wherein the number of cells in the second dimension is equal to or greater than the number of horizontal scan lines of the full color video display frame.

24. A method for the conversion of conventional color display format to field sequential color format of claim 21 wherein the storing of the digital video codes is comprising the steps of:

a) initializing the address selection means to select a first address location in the dynamic random access memory;

b) placing the first set of digital video codes in the first address location;

c) incrementing the address selection means to select to a second address location that is adjacent to the first address location on the first dimension of the array of the dynamic random access memory;

d) placing the second set of video codes in the second location;

e) repeatedly and sequentially incrementing the address selection means to select a next adjacent address in the dynamic random access memory until all the digital codes for the single horizontal scan line has been stored;

f) incrementing the address selection means to select a second address on the second dimension;

g) placing a second set of digital codes representing a second horizontal scan line of the full color video frame in the cells of the first dimension of the second address of the second dimension; and h) repeatedly and sequentially incrementing the address selection means and placing each of the horizontal scan lines of the full color video display at each address location on the second dimension until all scan lines are place in cells.

25. A method for the conversion of conventional color display format to field sequential color format of claim 21 wherein the retrieving of the digital video codes is further comprising the steps of:

a) initializing the address selection means to select a first address location of the first component color for the first picture element of the first horizontal scan line in the dynamic random access memory b) retrieving the first set of first digital video codes for the first component color c) placing the first set of digital video codes for the first component color on the Input/Output port;

d) repeatedly and sequentially incrementing the address selection means by a number of address locations equal to the number of component colors until all the locations containing the digital video codes that describe the first component color of the first horizontal scan line have been addressed;

e) repeatedly retrieving the next set of digital video codes for the first component color;

f) repeatedly placing the next set of digital video codes for the first component color at the Input/Output port; and g) incrementing the address selection means to select the second address location on the second dimension;

h) retrieving the second set of digital video codes representing the first component color of the horizontal scan line of the full color video display frame from all the cells on the first dimension of the second address on the second dimension;

i) repeatedly and sequentially incrementing the address selection means and retrieving all of the cells containing the first component color from each address on the second dimension until all of the horizontal scan lines for the first component color of the full color video display frame are retrieved; and j) repeating sequentially the aforementioned steps for each of the component colors until all the digital video codes for the full color video display frame have been serially placed on the Input/Output bus.

26. A method for the conversion of conventional color display format to field sequential color format of claim 21 wherein the step of repeating is further comprising the steps of:

a) successively connecting the input bus to a next Input/Output bus operably connected to a next dynamic random access memory;

b) storing of a next portion of the digital video codes to the next dynamic random access memory;

c) retrieving from the next dynamic random access memory the specifically ordered set video codes;

d) placing the specifically ordered set of video codes on the next Input/Output bus that is now operably coupled to the output bus which is the input to the "n" to one multiplexing means;

e) multiplexing the specifically ordered set of digital video codes to the serial stream of the specifically ordered set of digital video codes; and f) converting the serial stream of specifically ordered set of video codes in a digital-to-analog converter to an analog signal that is the input to the field sequential display.

27. A display format converter for the transformation of a Video Graphics Adapter Standard color video signals to a format for a field sequential color display comprising:

a) a video input means for the receiving of a video input signal representing three component colors, comprising the colors of red, green, and blue;

b) a digital video bus means connected to the video input means;

c) a buffer and arrange means connected to the digital video bus for buffering of a set of digital video codes to retain the set of digital video codes during the arranging of the set of digital video codes;

d) an input bus connected to the output of the buffer and arrange means;

e) a bus exchange means connected to said input bus wherein the input bus operably couples the buffer and arrange means to the bus exchange means;

f) Two Input/Output busses connected to the bus exchange means;

g) Two banks of dynamic random access memories connected to the two Input/Output busses to store a set of the multiple sets of digital video codes and to retrieve said set of the multiple sets of digital video codes in a specific order to form specifically ordered digital video codes;

h) an output bus connected to the bus exchange means;

i) a four-to-one multiplexing means to convert the specifically ordered digital video codes to a serial stream of said specifically ordered digital video codes;

j) a digital-to-analog converter connected to the output of the four-to-one multiplexing means for the conversion of the serial stream of specifically ordered digital video codes to an analog signal of the format acceptable as the input for a field sequential display; and k) a field sequential color display analog input means to operable couple the digital-to-analog converter to the field sequential color display.

28. The display format converter of claim 27 wherein the video input means may comprise an analog-to-digital conversion means if the video input signal is an analog video signal representing the magnitude of the plurality of component colors.

29. The display format converter of claim 27 wherein the video input means may comprise a digital receiver means if the video input signal is a set of digital video codes representing the magnitude of component colors.

30. A display format converter of claim 28 wherein the video analog-to-digital conversion means is further comprising:

a) an analog video input port operably coupled to the analog input means;

b) three analog-to-digital converters operably coupled to the analog video input port and a digital video output port for the conversion of the analog video signals, comprising a plurality of analog signals representing the magnitude of the red, green and blue component colors describing a video display frame, to a set of digital video codes representing the magnitude of the analog video signal; and c) the digital video output port operably coupled to the digital video bus.

31. The display format converter of claim 29 wherein the digital receiver places the digital video codes on the digital video bus.

32. The display format converter of claim 28 wherein the analog video signal is comprising a set of codes representing each the magnitudes of the colors red, green and blue describing a first full color video display frame of a plurality of full color video display frames.

33. The display format converter of claim 27 wherein the buffer and arrange means is further comprising:

a) an in-port operably coupling the digital video bus to two banks of storage cells;

b) the two banks of storage cells wherein each bank is organized in an array of rows and columns, with the in-port operably connected to the rows of the plurality of banks and an out-port operably coupled to the columns of the plurality of banks;

c) the out-port that is operably coupling the two banks of storage cells to the input bus; and d) a buffer control logic means that selects a single bank from the two banks of storage cells to activate to receive the digital video codes from the in-port, while simultaneously selecting the other of storage cells to activate to transmit the digital video codes in a rearranged order to the out-port.

34. The display format converter of claim 27 wherein the bus exchange means is comprising:

a) a first exchange port operably coupled to the input bus;

b) a second exchange port operably coupled to the output bus;

c) another pair of exchange ports operably coupled to two Input/Output busses, d) a switching means operably coupled to each of the exchange ports and to a coupling selection port; and e) an exchange selection means operably coupled to the coupling selection port to select the operable coupling of the first exchange port to one of the pair of exchange ports operably coupled to the two Input/Output busses, and the second exchange port to one of the other of the pair of exchange ports operably coupled to the two Input/Output busses, and to exchange the first and second exchange ports to the other of the exchange ports operably coupled to the two Input/Output busses.

35. The display format converter of claim 27 wherein each bank of dynamic random access memories is comprising:

a) an Input/Output port operably coupled to the Input/Output bus;

b) a plurality of storage cells organized into four channels of two dimensional arrays, each two dimensional array is comprising a first dimension and second dimension, wherein each cell can contain one digital video code;

c) an address selection means for selection of the set of storage cells where the digital video codes will be placed and retrieved; and d) a data steering logic means that operably couples the Input/Output port to the selected set of storage cells for the placement or removal of the digital video codes.

36. The display format converter of claim 35 wherein the number of storage cells of the first dimension of the array of the dynamic random access memory is 510.

37. The display format converter of claim 35 wherein the number of cells in the second dimension is equal to 480.

38. The display format converter of claim 35 wherein the storing of the digital video codes to the dynamic random access memories is comprising the steps of:

a) initializing the address selection means to select a first row and first column address location in the dynamic random access memory;

b) placing the first set of digital video codes in the first row and first column address location;

c) incrementing the address selection means to select to a second address location that is adjacent to the first address location on the first dimension of the array of the dynamic random access memory;

d) placing the second set of video codes in the second location;

e) repeatedly and sequentially incrementing the address selection means to select a next adjacent address in the dynamic random access memory until 510 address locations for the first row of the dynamic random access memory have been achieved;

f) repeatedly and sequentially a placing a next set of digital video codes in the next address location until all address locations of the first dimension of the dynamic random access memory contain a digital video code;

g) incrementing the address selection means to select a second address location on the second dimension;

h) placing a second set of digital video codes representing a second horizontal scan line of the Video Graphics Adapter Standard color video signals from the Input/Output bus into the cells of the second address location selected by the address selection means;

i) repeatedly and sequentially incrementing the address selection means until 480 address location on the second dimension are achieved;

j) repeatedly placing each of the remaining sets of digital video codes for the horizontal scan lines of the Video Graphics Adapter Standard video color signals in the cells of each address location selected by the address selection means.

39. A display format converter of claim 35 wherein the retrieving of the digital video codes is further comprising the steps of:

a) initializing the address selection means to select a first address location of the first component color of the dynamic random access memories b) retrieving the first set of first digital video codes for the first component color c) placing the first set of digital video codes for the first component color on the Input/Output port;

d) repeatedly and sequentially incrementing the address selection means by a number of address location equal to the number of component colors until the maximum of the address locations for the array of dynamic random address memories is exceeded or the maximum address location of the last digital video codes of the video display frame is exceeded, e) repeatedly retrieving the next set of digital video codes for the first component color;

f) repeatedly placing the next set of digital video codes for the first component color at the Input/Output port; and g) repeating the aforementioned steps for each of the component colors until all of the digital video codes for all component colors have been serially placed on the Input/Output port;

h) retrieving a second set of digital video codes representing a second horizontal scan line of the Video Graphics Adapter Standard color video signals from the Input/Output bus into the cells of the second address location selected by the address selection means;

i) repeatedly and sequentially incrementing the address selection means until 480 address location on the second dimension are achieved;

j) repeatedly retrieving each of the remaining sets of digital video codes for the horizontal scan lines of the Video Graphics Adapter Standard video color signals in the cells of each address location selected by the address selection means; and k) repeating the aforementioned steps for each of the three component colors until all the digital video codes have been serially placed on the Input/Output bus.

40. A display format converter of claim 27 wherein the four-to-one Multiplexor means is comprising:

a) an multiplexor input port operably connecting the output bus to a multiplexor means;

b) the multiplexor means that receives and retains the specifically ordered digital video codes from the multiplexor input port and places each individual code on an multiplexor output port in a serial and sequential pattern to create the serial stream of digital video codes; and c) the multiplexor output port operably connecting the multiplexor means to the digital-to-analog converter.

* * * * *